US009717347B1

(12) United States Patent
White

(10) Patent No.: US 9,717,347 B1
(45) Date of Patent: Aug. 1, 2017

(54) PRE-TERM INFANT MATTRESS

(71) Applicant: Clinton B. White, Hattiesburg, MS (US)

(72) Inventor: Clinton B. White, Hattiesburg, MS (US)

( * ) Notice: Subject to any disclaimer, the term of this patent is extended or adjusted under 35 U.S.C. 154(b) by 10 days.

(21) Appl. No.: 15/070,633

(22) Filed: Mar. 15, 2016

(51) Int. Cl.
*A47D 15/00* (2006.01)
*A47C 27/08* (2006.01)
*A61G 7/00* (2006.01)

(52) U.S. Cl.
CPC ..... *A47D 15/001* (2013.01); *A47C 27/081* (2013.01); *A47D 15/008* (2013.01); *A61G 7/00* (2013.01)

(58) Field of Classification Search
CPC ..... A47C 27/08; A47C 27/081; A47C 27/082; A47C 27/083; A47C 27/084; A47C 27/10; A61G 7/05769; A61G 7/05776; A47D 5/00; A47D 5/006; A47D 7/01; A47D 9/00; A47D 9/005; A47D 13/00; A47D 13/06; A47D 13/061; A47D 13/063; A47D 13/08; A47D 13/083; A47D 15/00; A47D 15/001; A47D 15/003
USPC ..... 5/655, 655.3, 654, 652, 706, 710, 713, 5/644
See application file for complete search history.

(56) References Cited

U.S. PATENT DOCUMENTS 2,629,884 A 3/1953 McMonagle
3,513,489 A 5/1970 Miller et al.
3,605,145 A * 9/1971 Graebe ..... A47C 27/081 297/DIG. 3
4,104,750 A * 8/1978 Kelter ..... A47D 9/005 5/703
4,698,864 A * 10/1987 Graebe ..... A47C 27/081 297/DIG. 3
4,873,734 A 10/1989 Pollard
5,052,068 A * 10/1991 Graebe ..... A47C 7/021 297/452.23
5,341,530 A * 8/1994 Ward ..... A47D 9/005 383/18
5,561,875 A * 10/1996 Graebe ..... A61G 5/1043 297/180.13
5,596,781 A * 1/1997 Graebe ..... A61G 5/1043 5/654
5,699,569 A * 12/1997 Schwarz-Zohrer ..... A47D 1/02 297/DIG. 3
6,505,366 B1 * 1/2003 Lied ..... A47D 15/003 5/425

(Continued)

OTHER PUBLICATIONS

ROHO Inc., Web Page, http://roho.com/category/products/therapeutic-mattresses/pediatric/.

*Primary Examiner* — Robert G Santos
(74) *Attorney, Agent, or Firm* — George L Williamson

(57) ABSTRACT

Method and apparatus for a pre-term infant mattress having a plurality of upstanding air chambers connected together pneumatically which air chambers generally surround the infant except for an open area above the head of the infant. Taller outer air chambers constrain the infant laterally wherein shorter inner air chambers provide a womb-like area on the sides of the infant. The air chambers are disposed on a pad having an inner central area with no air chamber to accommodate x-rays of the infant. An air tube is provided for supplying air to the individual air chambers having an air valve for adjusting the air pressure within the air mattress.

16 Claims, 2 Drawing Sheets

(56) References Cited

U.S. PATENT DOCUMENTS

| | | | | |
|---|---|---|---|---|
| 6,623,080 | B2 * | 9/2003 | Clapper | A47C 4/54 297/452.41 |
| 6,848,128 | B2 * | 2/2005 | Verbovszky | A47D 13/02 5/101 |
| 6,901,617 | B2 * | 6/2005 | Sprouse, II | A47C 4/54 297/219.1 |
| 7,059,000 | B2 * | 6/2006 | Verbovszky | A47D 13/02 5/655 |
| 7,178,186 | B2 * | 2/2007 | Harris | A47C 19/022 5/53.1 |
| 7,350,251 | B2 * | 4/2008 | Fraser | A47C 4/54 5/653 |
| 7,444,694 | B2 | 11/2008 | Brewin et al. | |
| 7,681,265 | B2 * | 3/2010 | Fraser | A47C 7/021 5/653 |
| 7,735,171 | B2 | 6/2010 | Kan | |
| 7,954,186 | B2 | 6/2011 | Flick | |
| 2003/0030319 | A1 * | 2/2003 | Clapper | A47C 4/54 297/452.41 |
| 2003/0192119 | A1 * | 10/2003 | Verbovszky | A47D 13/02 5/94 |
| 2003/0205920 | A1 * | 11/2003 | Sprouse, II | A47C 4/54 297/219.1 |
| 2005/0005362 | A1 * | 1/2005 | Verbovszky | A47D 13/02 5/655 |
| 2006/0010606 | A1 * | 1/2006 | Harris | A47C 19/022 5/706 |
| 2007/0011815 | A1 * | 1/2007 | Fraser | A47C 4/54 5/654 |
| 2008/0196166 | A1 * | 8/2008 | Fraser | A47C 7/021 5/654 |
| 2012/0011651 | A1 | 1/2012 | Moss | |

* cited by examiner

PRE-TERM INFANT MATTRESS

BACKGROUND OF THE INVENTION

Field of the Invention

The present invention relates generally to mattresses and, more particularly, is concerned with a mattress for pre-term infants.

Description of the Related Art

Devices relevant to the present invention have been described in the related art, however, none of the related art devices disclose the unique features of the present invention.

In U.S. Pat. No. 2,629,884 dated Mar. 3, 1953, McMonagle disclosed a baby's safety pad. In U.S. Pat. No. 3,513,489 dated May 26, 1970, Miller, et al., disclosed a bassinet. In U.S. Pat. No. 4,873,734 dated Oct. 17, 1989, Pollard disclosed a bumper sheet. In U.S. Pat. No. 7,735,171 dated Jun. 15, 2010, Kan disclosed a support structure with side guards. In U.S. Pat. No. 7,954,186 dated. Jun. 7, 2011, Flick disclosed an inflatable mattress with uniform restraint. In U.S. Pat. No. 7,444,694 dated Nov. 4, 2008, Brewin, et al., disclosed an infant sleep positioner. In U.S. Patent Application Publication U.S. 2012/0011651 dated Jan. 19, 2012, Moss disclosed in inflatable mattress guard.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a pre-term infant mattress having a plurality of upstanding air chambers connected together pneumatically. An outer row of taller air chambers surround and secure the infant on the left and right side and the feet of the infant leaving an open space above the infant's head while an inner row of shorter air chambers line the area on the left and right side providing comfort to the infant. The taller outer air chambers constrain the infant laterally thereby retaining the infant within the receptacle area. The air chambers are disposed on a pad having an inner central area with no air chamber to accommodate x-rays of the infant. An air tube is provided for supplying air to the individual air chambers having an air valve on the end thereof.

An object of the present invention is to provide an improved mattress for pre-term infants. A further objective of the present invention is to provide the mattress having a plurality of air chambers thereon to simulate a womb environment for the baby in order to promote physiologic stability and optimum development of the musculosketal alignment of the pre-term infant. A further object of the present invention is to provide a pre-term infant mattress suitable for use in a hospital environment. A further object of the present invention is to provide a pre-term infant mattress which can be easily operated by a user. A further object of the present invention is to provide a pre-term infant mattress which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
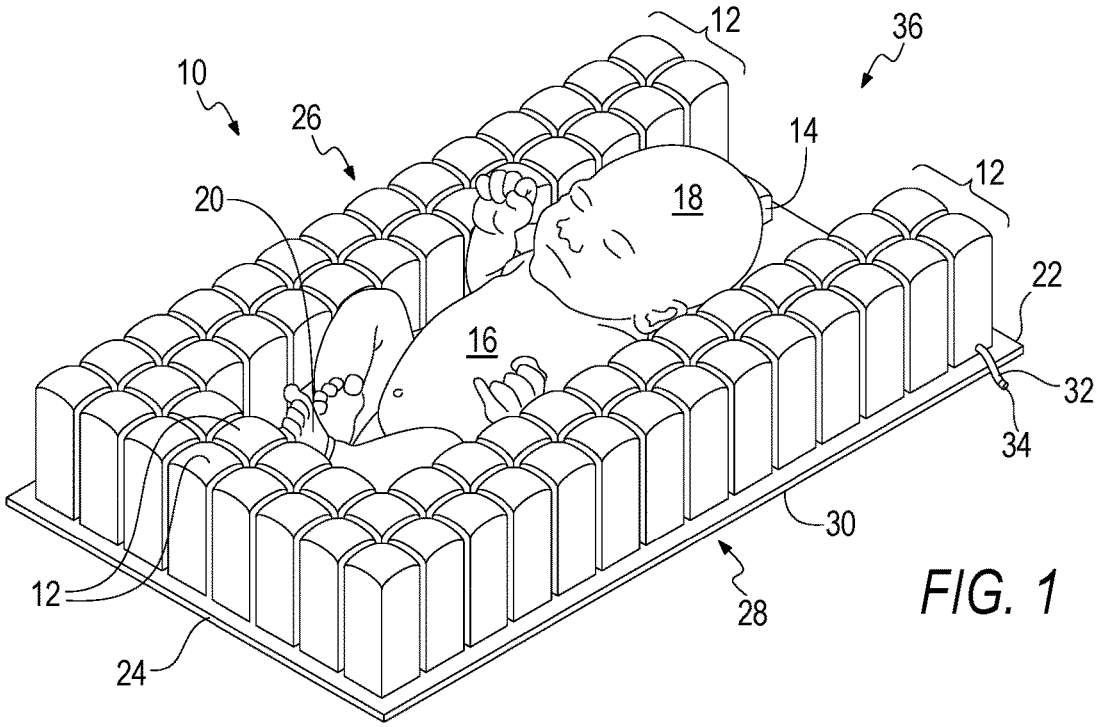
FIG. 1 is a perspective view of the present invention shown in operative connection taken from the lower end of the present invention.

With regard to reference numerals used, the following numbering is used throughout the drawings.

10 present invention
12 outer, taller air chambers
14 interior, shorter air chambers
16 pre-term infant
18 head of infant
20 feet of infant
22 upper end of mattress
24 lower end of mattress
26 left side of mattress
28 right side of mattress
30 bottom sheet or pad
32 air tube
34 air valve
36 open area above head of baby
38 solid area
40 left air chamber
42 right air chamber
44 air passageway
46 sloping line
48 receptacle area
50 cover
52 centerline

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 4 illustrate the present invention wherein a pre-term infant mattress is disclosed and which is generally indicated by reference number 10.

Figure 2:
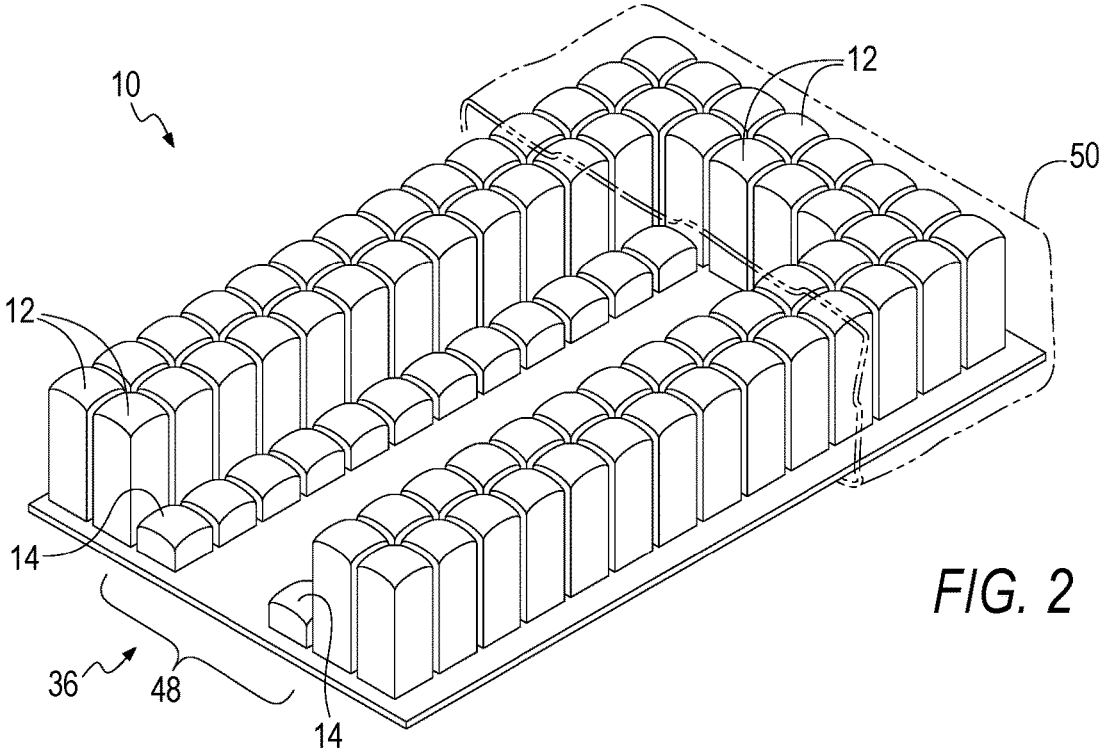
FIG. 2 is a perspective of the present invention taken from the upper end of the present invention.
Figure 3:
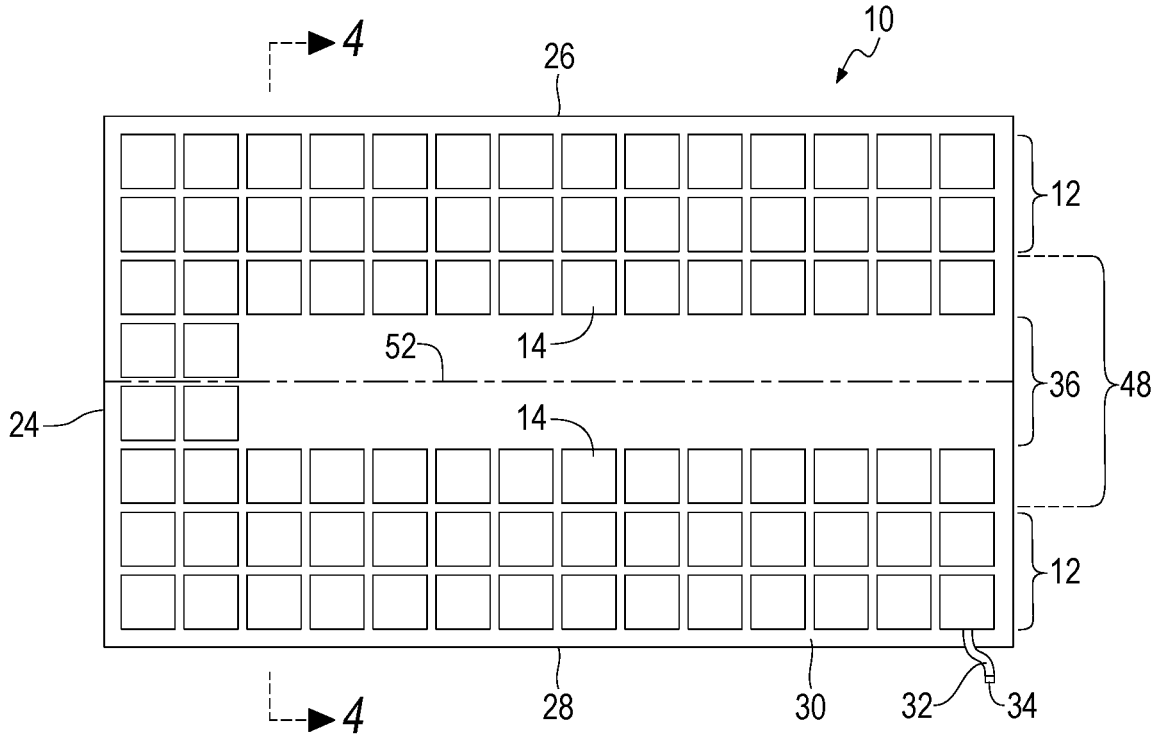
FIG. 3 is a plan view of the present invention.

Turning to FIGS. 1-3, therein is shown the present invention 10 having two rows of outer, taller air chambers 12 on the left and right side of the infant 16 and at the lower end of the infant, and a single row of shorter, interior air chambers 14 provided on the left and right sides of the infant. The taller, outer rows of upstanding individual air chambers 12 are approximately four inches in height and together defines a secure holding area 48 (best seen on FIG. 2) for the infant 16 while the interior row of shorter, air chambers 14 are approximately one inch in height wherein the shorter interior air chambers are intended to simulate a womb-like environment for the infant 16. Also shown are the head 18 and feet 20 of the infant 16. In general, the present invention 10 has a plurality of individual air chambers surrounding the infant 16 except for the open area 36 above the head of the infant. The air mattress 10 is also generally defined by a head or upper end portion 22 and a foot or lower end portion 24 along with a left side portion 26 and a right side portion 28. Also shown is a bottom pad 30 on which the individual air chambers 12, 14 are disposed wherein the bottom pad or sheet 30 has an air tube 32 for inputting and removing air along with an air valve 34 for adjusting the pressure as required for comfort and operation of the present invention 10. Note the open area 36 defined on the upper end of the mattress inside the air chambers 14 and being the approximate width of the head of infant 16 wherein there are no air chambers in order to allow the baby to be removed from and placed upon the infant air mattress of the present invention 10 being generally indicated by reference number 36. A cover 50 is also shown in phantom for providing sanitation and protection to the present invention 10 when it is not in use. Cover 50 is expected to be made of nylon, polypropylene or the like and while FIG. 2 shows the cover only partially covering the mattress, the cover would entirely cover the present invention when in operative connection. Centerline 52 is also shown.

Figure 4:
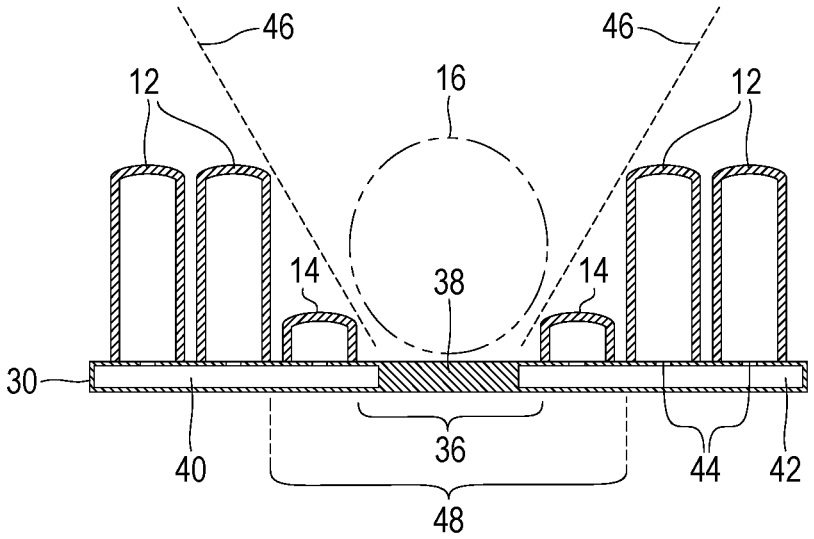
FIG. 4 is a cross sectional view of the present invention taken from FIG. 3 as indicated.

Turning to FIG. 4, therein is shown the present invention 10 having two outer rows of taller air chambers 12 and an inner row of shorter air chambers 14. A sloping line 46 is shown generally aligning the upper, inner edges of the air chambers 12, 14 of the present invention 10 to illustrate the graduated disposition of the air chambers which in general slope from the interior toward the exterior of pad 30 and is intended to illustrate that the inner row of shorter air chambers 14 provide comfort to the infant 16 while the outer rows of taller air chambers 12 confine and restrain the infant within the receptacle area 48 of the present invention. It is expected that sloping line 46 will form an angle with bottom pad or sheet 30 of at least forty-five degrees. The underlying bottom sheet or pad 30 is shown having an interior, centralized solid area portion 38 and having a left air chamber 40 and a right air chamber 42 wherein apertures 44 are used to denote air passageways from the air chambers 40, 42 into the individual air chambers 12, 14. While not shown on FIG. 4, the left and right air chambers 40, 42 are pneumatically connected. The solid portion 38 of the bottom pad 30 is free of air chambers and is important because it allows for the unhindered x-raying of the infant as it is known that pre-term infants require numerous x-rays to be taken contrary to full term infants. Also shown therein is the infant 16 placed generally within the receptacle area or interior space 36 provided by the interior row of air chambers 14.

It is expected that the present invention 10 will be made of flexible rubber or plastic-like material suitable for inflatable mattresses which material is also relatively easy to clean making it suitable for use in a hospital or like medical facility where cleanliness is a priority. The air pressure within the present invention 10 can be adjusted by the operator using the air valve 34 to either soften or harden the mattress to provide a comfort level suitable for the infant.

By way of summary and with reference to FIGS. 1-4, the present invention 10 discloses a method for a mattress for a pre-term infant 16 including: a) a bottom pad 30 being generally rectangular shaped having an upper surface and longer first and second sides 26, 28 and shorter upper and lower ends 22, 24, and a centerline 52 parallel to the longer first and second sides; b) providing a plurality of upstanding air chambers 12, 14 disposed on the upper surface having a row of shorter air chambers 14 disposed on each first and second side of the centerline separated from each other by a distance wide enough to form a receptacle 48 for the pre-term infant, and a plurality of rows of taller air chambers 12 being disposed between the row of shorter air chambers and the first and second sides of the bottom pad, and at least one row of taller air chambers being disposed parallel to and adjacent the lower end of the bottom pad; c) providing a solid area 38 on the bottom pad extending along the centerline between the rows of shorter air chambers and extending from the lower end to upper end to permit x-rays to be taken of the pre-term infant; d) providing a bottom air chamber 40, 42 internal the bottom pad, the bottom air chamber being pneumatically connected at 44 to each taller air chamber and each shorter air chamber; e) providing an open area 36 adjacent the upper end to permit the pre-term infant to be placed into and removed from the receptacle of the mattress; and, f) providing an air inlet 32 connected to the bottom air chamber to permit air to be input and removed therefrom. Further, wherein the taller air chambers are about four times as tall as the shorter air chambers; wherein the taller air chambers are about as tall as the height of the pre-term infant in a reclined position; wherein the shorter air chambers are about one inch long; providing an air valve 34 on the air inlet for adjusting air pressure within the bottom air chamber; wherein the first and second rows of the shorter air chambers simulate a womb environment for the pre-term infant; wherein the first and second rows of the taller air chambers provide a retaining wall to secure the pre-term infant in the receptacle area of the mattress; and, wherein a straight line 46 touching an inner, upper edge of the shorter and the taller air chambers forms an angle of at least forty-five degrees relative to the bottom pad.

I claim:

1. A mattress for a pre-term infant, comprising:

a) a bottom pad being generally rectangular shaped having an upper surface and longer first and second sides and shorter upper and lower ends, and a centerline parallel to said longer first and second sides;

b) a plurality of upstanding air chambers disposed on said upper surface having a row of shorter said air chambers disposed on each said first and second side of said centerline separated from each other by a distance wide enough to form a receptacle for the pre-term infant, and a plurality of rows of taller said air chambers being disposed between said row of said shorter air chambers and said first and second sides of said bottom pad, and at least one row of said taller air chambers being disposed parallel to and adjacent said lower end of said bottom pad;

c) said bottom pad having a solid area extending along said centerline between said rows of said shorter air chambers and extending from said lower end to said upper end to permit x-rays to be taken of the pre-term infant;

d) a bottom air chamber being disposed internal said bottom pad, said bottom air chamber being pneumatically connected to each said taller air chamber and each said shorter air chamber;

e) an open area adjacent said upper end to permit the pre-term infant to be placed into and removed from said receptacle of the mattress; and, f) an air inlet connected to said bottom air chamber to permit air to be input and removed therefrom.

2. The mattress of claim 1, wherein said taller air chambers are about four times as tall as said shorter air chambers.

3. The mattress of claim 2, wherein said taller air chambers are configured to be about as tall as the height of the pre-term infant in a reclined position.

4. The mattress of claim 3, wherein said shorter air chambers are about one inch long.

5. The mattress of claim 4, further comprising an air valve being disposed on said air inlet for adjusting air pressure within said bottom air chamber.

6. The mattress of claim 5, wherein said first and second rows of said shorter air chambers simulate a womb environment for the pre-term infant.

7. The mattress of claim 6, wherein said first and second rows of said taller air chambers provide a retaining wall to secure the pre-term infant in said receptacle area of the mattress.

8. The mattress of claim 7, wherein a straight line touching an inner, upper edge of said shorter and said taller air chambers forms an angle of at least forty-five degrees relative to said bottom pad.

9. A method for a mattress for a pre-term infant, comprising the steps of:

a) providing a bottom pad being generally rectangular shaped having an upper surface and longer first and second sides and shorter upper and lower ends, and a centerline parallel to the longer first and second sides;

b) providing a plurality of upstanding air chambers disposed on the upper surface having a row of shorter air chambers disposed on each first and second side of the centerline separated from each other by a distance wide enough to form a receptacle for the pre-term infant, and a plurality of rows of taller air chambers being disposed between the row of shorter air chambers and the first and second sides of the bottom pad, and at least one row of taller air chambers being disposed parallel to and adjacent the lower end of the bottom pad;

c) providing a solid area on the bottom pad extending along the centerline between the rows of shorter air chambers and extending from the lower end to upper end to permit x-rays to be taken of the pre-term infant;

d) providing a bottom air chamber internal the bottom pad, the bottom air chamber being pneumatically connected to each taller air chamber and each shorter air chamber;

e) providing an open area adjacent the upper end to permit the pre-term infant to be placed into and removed from the receptacle of the mattress; and, f) providing an air inlet connected to the bottom air chamber to permit air to be input and removed therefrom.

10. The method of claim 9, wherein the taller air chambers are about four times as tall as the shorter air chambers.

11. The method of claim 10, wherein the taller air chambers are configured to be about as tall as the height of the pre-term infant in a reclined position.

12. The method of claim 11, wherein the shorter air chambers are about one inch long.

13. The method of claim 12, further comprising the step of providing an air valve on the air inlet for adjusting air pressure within the bottom air chamber.

14. The method of claim 13, wherein the first and second rows of the shorter air chambers simulate a womb environment for the pre-term infant.

15. The method of claim 14, wherein the first and second rows of the taller air chambers provide a retaining wall to secure the pre-term infant in the receptacle area of the mattress.

16. The method of claim 15, wherein a straight line touching an inner, upper edge of the shorter and the taller air chambers forms an angle of at least forty-five degrees relative to the bottom pad.

* * * * *